US006775846B1

(12) United States Patent
LaFauci et al.

(10) Patent No.: US 6,775,846 B1
(45) Date of Patent: Aug. 17, 2004

(54) SLEEVE HOLDER

(75) Inventors: Mary G. LaFauci, Philadelphia, PA (US); Catherine J. Maddaloni, Pottstown, PA (US)

(73) Assignee: L&N Sales and Marketing, Inc., Hatboro, PA (US)

( * ) Notice: Subject to any disclaimer, the term of this patent is extended or adjusted under 35 U.S.C. 154(b) by 0 days.

(21) Appl. No.: 10/757,935

(22) Filed: Jan. 14, 2004

(51) Int. Cl.[7] ..... A41B 1/08
(52) U.S. Cl. ..... 2/125
(58) Field of Search ..... 2/125, 126, 170, 2/289, 171, 113, 270, 115, 321, 311–312, 69, 317, 920, 338, DIG. 11; 24/306, 442

(56) References Cited

U.S. PATENT DOCUMENTS

| | | | | | |
|---|---|---|---|---|---|
| 2,446,018 | A | | 7/1948 | Miskimen | |
| 3,000,119 | A | | 9/1961 | Altman | |
| 3,086,529 | A | * | 4/1963 | Munz et al. | 606/203 |
| 3,542,041 | A | | 11/1970 | Mercorella | |
| 4,825,475 | A | | 5/1989 | Smart | |
| D344,177 | S | | 2/1994 | Mennie et al. | |
| 5,456,274 | A | * | 10/1995 | Selbee et al. | 132/275 |
| 5,555,561 | A | * | 9/1996 | Plachta et al. | 2/457 |
| 5,826,598 | A | | 10/1998 | Meehan | |
| D402,091 | S | | 12/1998 | Bratcher | |
| 5,867,839 | A | | 2/1999 | Lawlor | |
| 5,890,494 | A | | 4/1999 | Sonstegard | |
| 6,000,408 | A | | 12/1999 | Maturaporn | |
| 6,023,786 | A | | 2/2000 | Burnett | |
| D426,026 | S | | 5/2000 | Maturaporn | |
| 6,081,925 | A | | 7/2000 | Reiber | |
| 6,175,961 | B1 | * | 1/2001 | Linden et al. | 2/125 |
| D447,281 | S | | 8/2001 | Maturaporn | |
| 6,272,691 | B1 | | 8/2001 | Henricksen et al. | |
| D449,134 | S | | 10/2001 | Maturaporn | |
| 2003/0074770 | A1 | | 4/2003 | Roscow | |

* cited by examiner

*Primary Examiner*—Tejash Patel
(74) *Attorney, Agent, or Firm*—Drinker Biddle & Reath LLP

(57) ABSTRACT

A sleeve holder for maintaining a garment sleeve in a rolled-up condition adjacent a person's shoulder includes a body and attachment portions connected to opposite ends of the body. The body includes a cover and an elastic core located within an interior of the cover. The cover defines a cross section that reduces in size between an intermediate part of the cover and the ends of the body. The attachment portions support hook and loop portions of a hook and loop connector for releasable engagement between the attachment portions. The cover is attached to the core adjacent the ends of the body while the core is held at a stretched length to form gathered portions of the cover when the core is released to a relaxed length.

13 Claims, 5 Drawing Sheets

SLEEVE HOLDER

FIELD OF THE INVENTION

The present invention relates generally to wearing apparel. More particularly, the present invention relates to a sleeve holding device for garments such as shirts, jerseys and the like.

BACKGROUND OF THE INVENTION

Players of certain sports, such as soccer and basketball, use sleeve holders to maintain the sleeves of a jersey, or like garment, in a rolled or gathered condition. The holders are received by the sleeves of the garment to hold the sleeves adjacent to the shoulders of a wearer. The sleeve holders give the wearer a sense of reduced encumbrance, which is desirable in a variety of sports. The securing of the garment sleeves adjacent the shoulders also increases exposure of the wearer's skin thereby promoting endurance during play in hot-weather conditions.

The sleeve holder is received through either the neck opening of the garment or the associated arm opening. The opposite ends of the sleeve holder are then attached to each other such that the portion of the garment between the neck opening and associated arm opening, which includes the rolled or gathered sleeve, is encircled by the holder.

SUMMARY OF THE INVENTION

According to the present invention, there is provided a device for holding a sleeve of a garment in a rolled or gathered condition adjacent a wearer's shoulder. The sleeve holding device includes an elongated body having opposite ends. The body includes a elastic core located within an interior defined by a cover. The elastic core has a relaxed length and a relatively longer stretched length in response to an applied tensile force.

The sleeve holding device includes first and second end attachment portions connected to the body portion. The end attachment portions are adapted for engagement with each other. The body cover defines a cross section that reduces in size between an intermediate part of the body and the opposite ends of the body.

According to one embodiment of the invention, the cover is attached to the core adjacent the opposite ends of the body while the core is held at its stretched length such that the cover defines gathered portions when the core is released to its relaxed length.

Preferably, the first and second end attachment portions support hook and loop portions of a hook and loop connector for releasable engagement between the end attachment portions.

According to a preferred embodiment, the body cover is made from a length of fabric material having opposite side edge portions secured to each other define a closed cross section. Preferably, the secured edge portions of the fabric material are located within the interior defined by the cover.

DETAILED DESCRIPTION OF THE DRAWINGS

Figure 1:
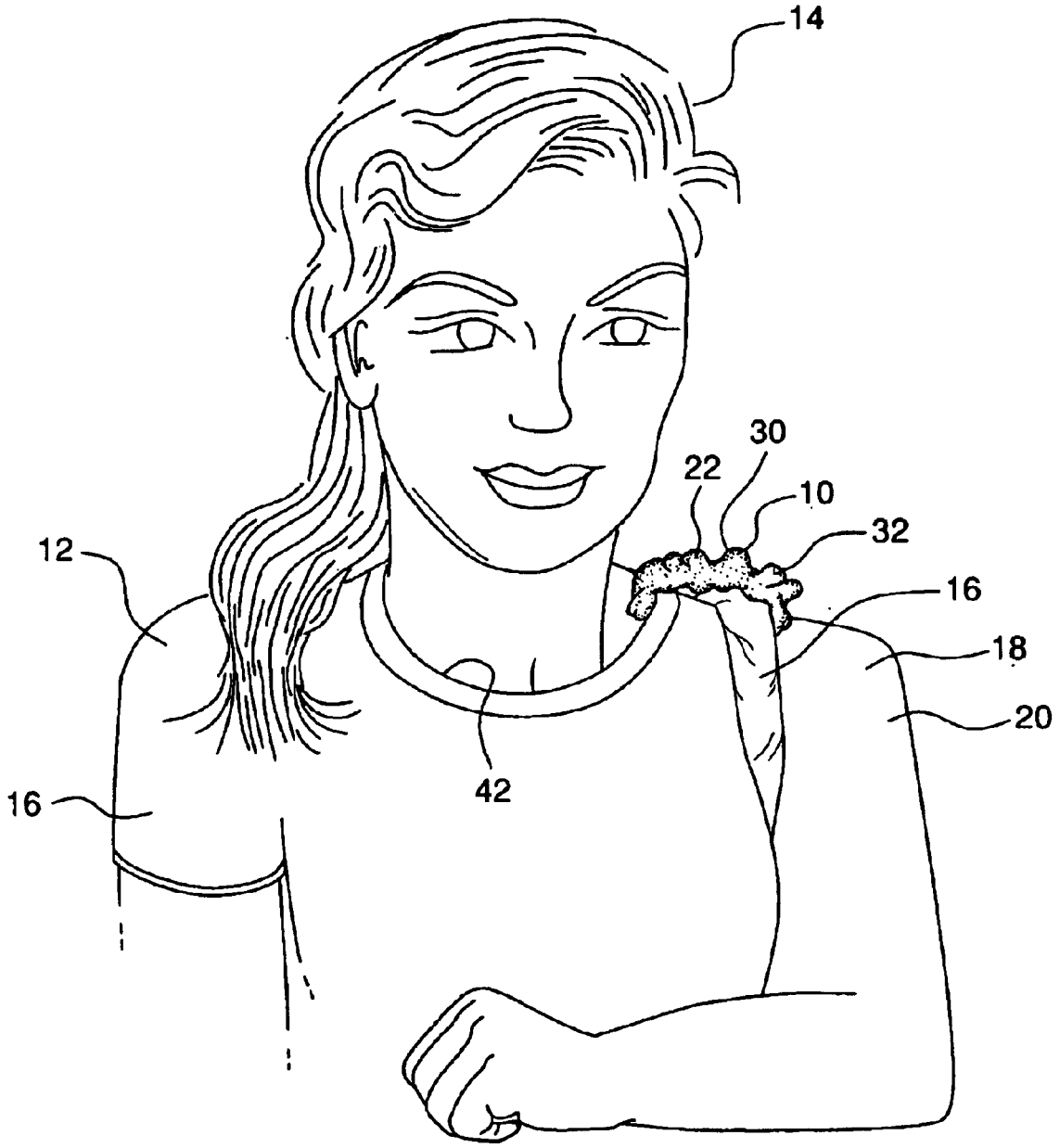
FIG. 1 is a perspective illustration showing a sleeve holder according to the present invention secured to a garment to maintain a sleeve of the garment adjacent the wearer's shoulder.

Referring to the drawings where like numerals identify like elements, there is illustrated in FIG. 1 a sleeve holder 10 according to the present invention secured to a shirt 12 worn by a person 14. The sleeve holder 10 maintains a sleeve 16 of the shirt adjacent a shoulder 18 of the person 14. The shirt 12 shown in FIG. 1 is a short-sleeved T-shirt. It should be understood, however, that the sleeve holder 10 could be used with other types of sleeved garments, such as sports jerseys for example, having short or long sleeves.

The sleeve 16 of the shirt 12 is shown in FIG. 1 in a rolled-up condition adjacent the shoulder 18. Alternatively, the sleeve holder 10 could be used to maintain the sleeve in a gathered, or bunched, condition adjacent the shoulder. As shown, the securing of the sleeve 16 in this manner exposes the arm 20 of the person 14 in a similar fashion as a sleeveless shirt. This promotes freedom of movement for the person's arm 20, desirable for players of various sports. The increased exposure of the arm 20 also promotes increased endurance for playing of sports in hot-weather conditions.

As will be described in greater detail, the sleeve holder 10 is adapted for removable attachment to a garment. The use of the removable sleeve holder 10 for maintained arm exposure, instead of removal of the sleeve, preserves the integrity of the garment for wearing of the sleeves in an unrolled condition at other times. This is desirable when the garment is a uniform worn by a member of a team of players, for example.

Figure 2:
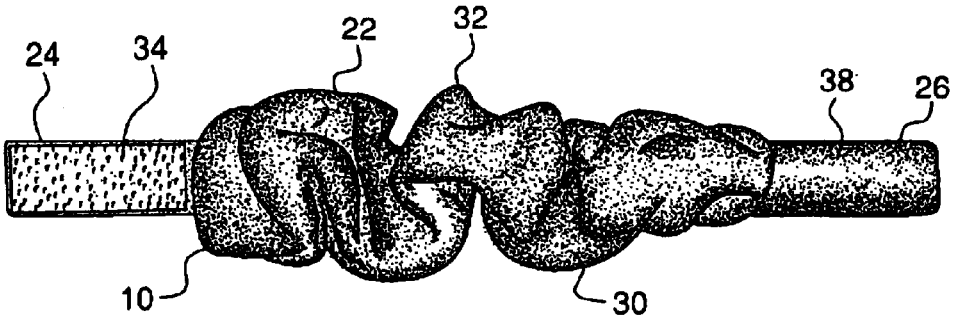
FIG. 2 is a top plan view of the sleeve holder of FIG. 1 with the opposite end portions separated from each other to define an opened condition for the sleeve holder.
Figure 3:
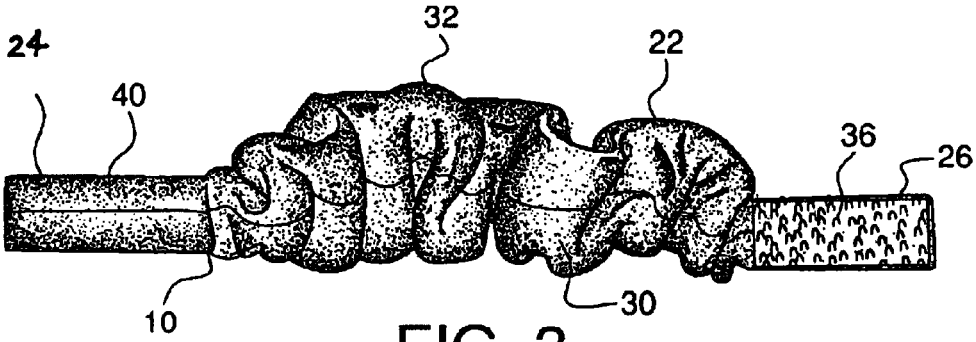
FIG. 3 is a bottom plan view of the sleeve holder of FIG. 2.
Figure 4:
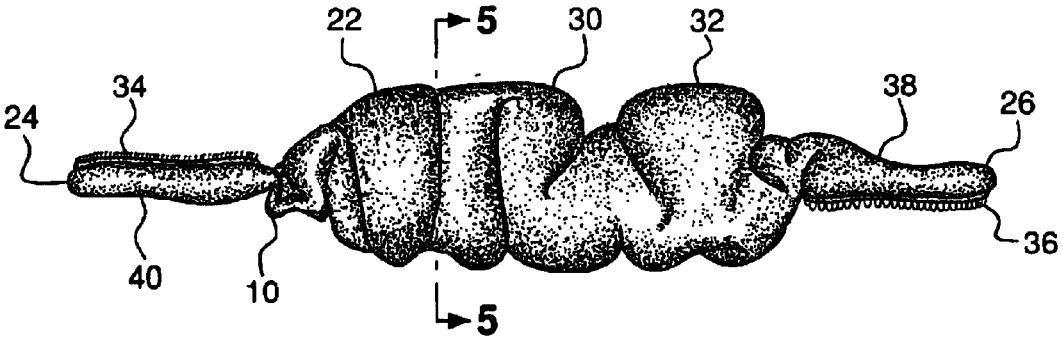
FIG. 4 is a side elevation view of the sleeve holder of FIG. 2.

Referring to FIGS. 2–5, the sleeve holder 10 includes a central body portion 22 and opposite end attachment portions 24, 26 connected to the body portion 22. The end attachment portions 24, 26 are shown in FIGS. 2–4 separated from each other. As described below in greater detail, the end attachment portions 24, 26 are adapted for engagement with each other to secure the sleeve holder 10 in a closed condition.

Figure 5:
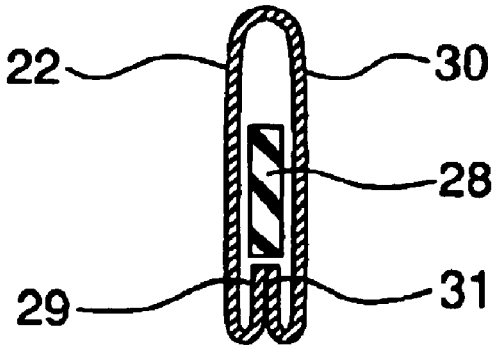
FIG. 5 is a section view taken along the line 5—5 of FIG. 4.

As shown in the sectional view of FIG. 5, the sleeve holder 10 is composite in construction having an internal core 28 enclosed by an outer cover 30. The outer cover 30 is preferably made from a fabric material. To form the cover 30, a piece of fabric material is secured along longitudinally extending side edge portions 29, 31, preferably by a seam line of stitching (not shown), such that the piece of fabric defines a closed cross section in the nature of an elongated tube. The secured edge portions 29, 31 are located within an interior defined by the cover 30 by turning the fabric tube inside out. This serves to conceal the joined edge portions 29, 31 within an interior defined by the inverted fabric tube thereby promoting a clean appearance in the resulting exterior of the cover 30.

The core 28 is made from an elastic material such that it will increase in length longitudinally from a relaxed length in response to an applied tensile load. As shown in FIGS. 2–4, the outer cover 30 defines gathered, or bunched, portions 32 of the fabric material. The gathered fabric portions 32 are formed by attaching the elastic core 28 to the cover 30 when the core 28 is held in a stretched condition. The cover 30 has a length that corresponds to a stretched length for the elastic core 28. The core 28 is attached to the cover 30 adjacent the end attachment portions 24, 26. The core 28 and cover 30, however, are not attached between the end attachment portions 24, 26. As a result, the return of the elastic core 28 to its relaxed length following removal of the tensile load causes compression of the cover 30 resulting in the formation of the gathered portions 32.

The composite construction of the sleeve holder body 22 is similar to that of hair bands marketed under the SCUNCI® trademark by L&N Sales and Marketing, Inc. and shown in Design U.S. Pat. No. Des. 292,030. The extensible nature of the body 22 of sleeve holder 10 facilitates use of a given sleeve holder with differing garment types, such as long sleeved and short sleeved shirts, or with garments of the same type made from varying materials forming rolls of differing thickness.

Referring again to FIGS. 2–4, attachment end portions 24, 26 of the sleeve holder 10 respectively support hook and loop portions 34, 36 of a hook and loop connector. The hook and loop portions 34, 36 are secured to the end attachment portions 24, 26 by stitching or other means, such as an adhesive. Engagement between the hook and loop portions 24, 26 provides for releasable connection between the end attachment portions 24, 26. In the opened condition of FIGS. 2 and 3, the sleeve holder 10 defines opposite top and bottom surfaces 38, 40. As shown, the hook and loop portions 34, 36 of the hook and loop connector are respectively secured to the top and bottom surfaces 38, 40.

Referring again to FIG. 1, the sleeve holder 10 is received by the shirt 12, through the neck opening 42, or one of the opposite arm openings, such that a portion of the body 22 extends within the shirt 12 between the neck opening 42 and the rolled-up sleeve 16. The sleeve holder 10 is then returned upon itself in an overlying manner with a portion of the holder 10 within the shirt 12 and a portion of the holder without. Engagement of the hook and loop portions 34, 36 of the hook and loop connector defines a closed loop encircling the rolled-up sleeve 16.

Figure 6:
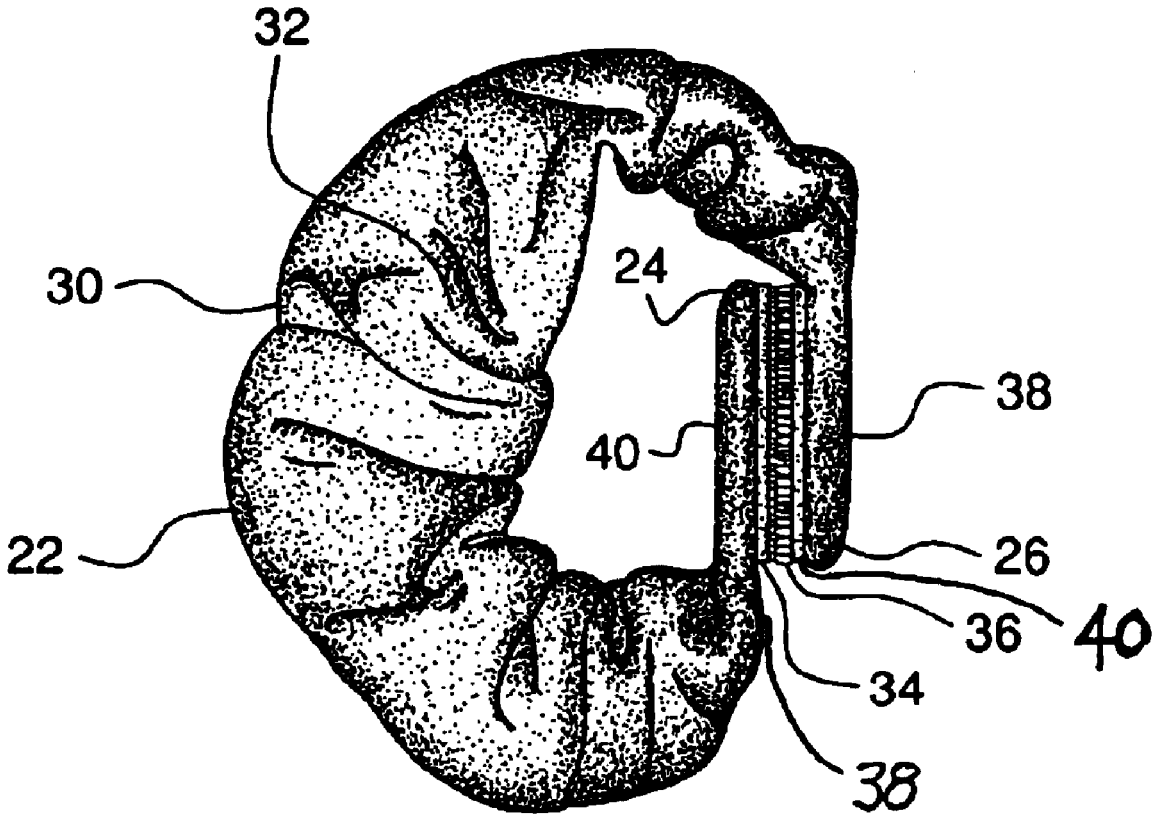
FIG. 6 is a side view of the sleeve holder of FIG. 1 with the opposite end portions engaged with each other to define a closed condition for the sleeve holder.

Referring to FIG. 6, the sleeve holder 10 is shown removed from the shirt 12 in its closed condition defining a closed loop. As discussed above, the hook and loop portions 34, 36 are respectively secured to opposite surfaces 38, 40 of the sleeve holder 10. In the closed condition shown in FIG. 6, the end attachment portions 24, 26 are connected such that the end attachment portions form part of the closed loop defined by the sleeve holder 10. This configuration facilitates positioning of the connected end portions 24, 26 in a concealed location within the shirt 12 in the manner shown in FIG. 1.

Figure 7:
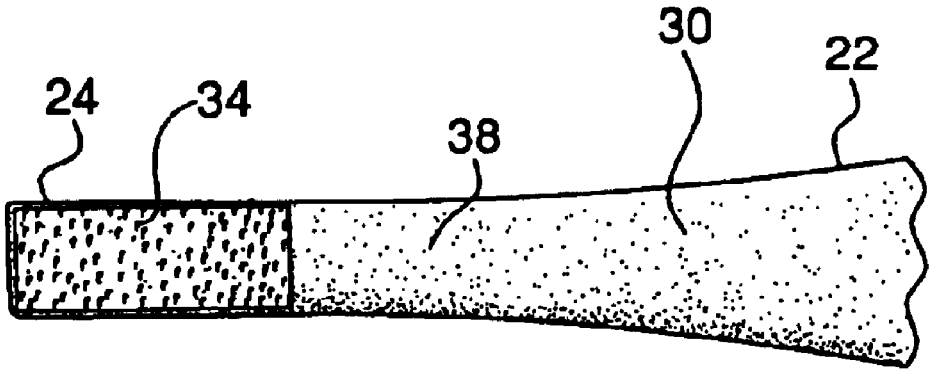
FIG. 7 is a partial top plan view of the sleeve holder of FIG. 1 with the body shown in an extended condition.

Referring to FIG. 7, a portion of the sleeve holder 10 of FIG. 2 is shown in a stretched condition in which the compression of the outer cover 30, and the resulting bunching thereof, has been eliminated. As shown, the cross section defined by the outer cover 30, as discussed above and shown in FIG. 5, varies in size along the length of the outer cover 30. This may be accomplished by providing the piece of fabric forming the cover 30 with a width that tapers along the length of the fabric such that the opposite side edges 29, 31 taper towards each other between a central part of the fabric piece and its opposite ends. Securing of the edge portions 29, 31 as shown in FIG. 5 results in the outer cover shown in FIG. 7.

Figure 8:
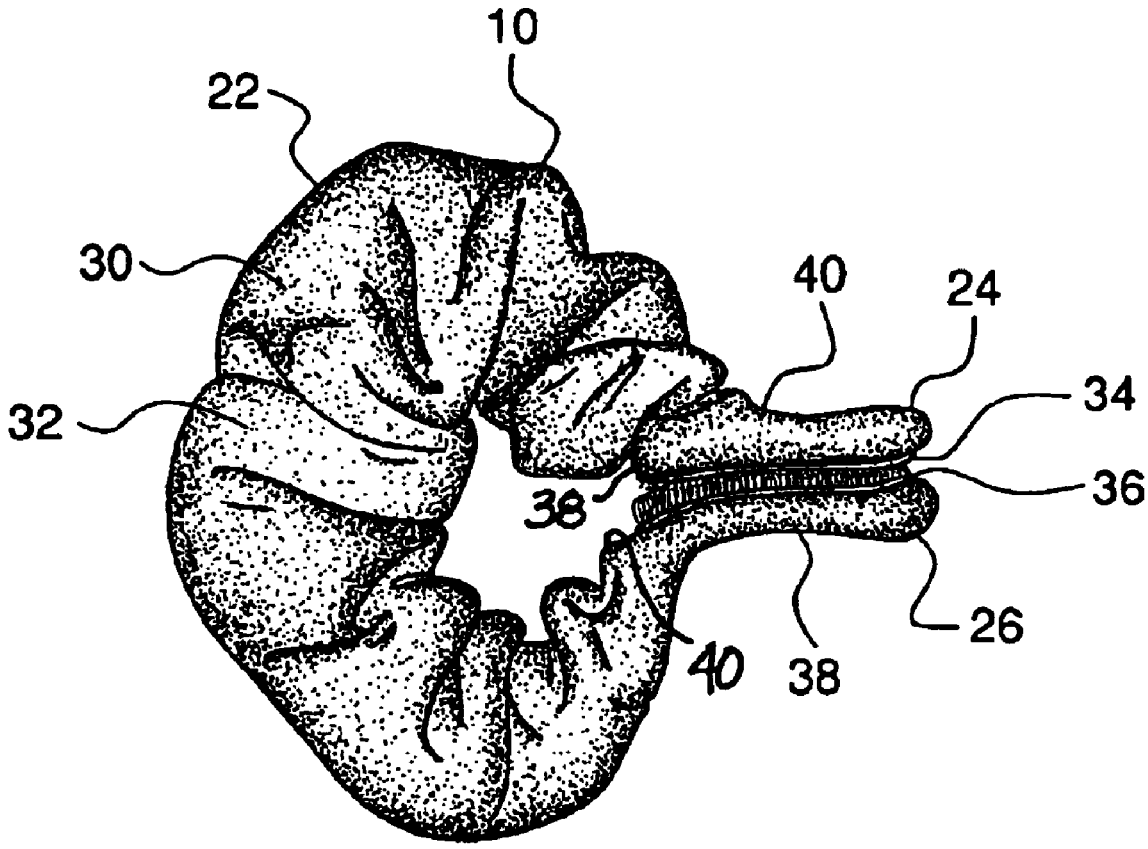
FIG. 8 is a side view of the sleeve holder of FIG. 6 with the opposite end portions engaged with each other in an alternative orientation to define a closed condition.

Referring to FIG. 8, an alternate closed condition for the sleeve holder 10 is shown. In the closed configuration of FIG. 6, the connected end attachment portions 24, 26 formed a part of the closed loop defined by the sleeve holder 10. In the alternate configuration shown in FIG. 8, the opposite ends of the sleeve holder 10 have been rotated with respect to each other prior to connection between the end attachment portions 24, 26. Connection between the hook and loop portions 34, 36 results in the end attachment portions 24, 26 being located outside of a substantially closed loop defined by the body portion 22. The sleeve holder 10 could be secured to the shirt 12 in the alternate configuration of FIG. 8 such that the connected end attachment portions 24, 26 are located adjacent the person's shoulder 18. Alternatively, the sleeve holder 10 could be secured to the shirt 12 such that the connected end attachment portions 24, 26 are located adjacent the neck opening 40 of the shirt 12 instead of the shoulder 18.

The person 14 is shown in FIG. 1 with only one of the sleeves 16 in a rolled-up condition to facilitate the description of the present invention. It should be understood that a pair of sleeve holders 10 would typically be used by a person to secure both sleeves 16 of the shirt 12 in a rolled-up condition.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A device for holding a sleeve of a garment in a rolled or gathered condition adjacent a wearer's shoulder, the device comprising:

an elongated body portion having opposite ends, the body portion including a core and a cover, the core located within an interior defined by the cover, the core being elastic to provide for a relaxed length of the core and a relatively longer stretched length in response to an applied tensile force; and first and second end attachment portions connected to the opposite ends of the body portion, the end attachment portions adapted for engagement with each other, the cover of the body portion defining a cross section that varies in size, the cover cross section reducing in size between an intermediate part of the body portion and the opposite ends of the body portion.

2. The sleeve holding device according to claim 1, wherein the cover of the body portion is attached to the core adjacent the opposite ends of the body portion.

3. The sleeve holding device according to claim 2, wherein the cover of the body portion is attached to the core when the core is held at its stretched length to define gathered portions of the cover when the core is at its relaxed length.

4. The sleeve holding device according to claim 3, wherein the cover has an ungathered length that is approximately equal to the stretched length of the core of the body portion.

5. The sleeve holding device according to claim 1, wherein the first and second end attachment portions respectively support hook and loop portions of a hook and loop connector for releasable engagement between the end attachment portions.

6. The sleeve holding device according to claim 1, wherein the cover of the body portion is made from a length of a fabric material having opposite side edge portions secured to each other to define a closed cross section.

7. The sleeve holding device according to claim 6, wherein the secured edge portions of the fabric cover are located within the interior defined by the cover.

8. A device for holding a garment sleeve adjacent a wearer's shoulder, the device comprising:

an outer cover made from a fabric material, the outer cover defining a closed cross section forming an interior, the cross section tapering in size between an intermediate portion of the cover and opposite end portions of the cover;

an inner core made from an elastic material to provide extension of inner core from a relaxed length to a relatively longer stretched length under an applied tensile force; and a connector including first and second parts secured to the opposite end portions of the cover for connection of the opposite end portions to each other.

9. The device according to claim 8, wherein the connector is a book and loop connector including portions of hook and loop material.

10. The device according to claim 8, wherein the sleeve holder defines opposite first and second surfaces and wherein the first and second connector parts are respectively connected to the first and second surfaces such that the connector parts are oppositely located from each other when the sleeve holder is in an opened condition.

11. The device according to claim 8, wherein the outer cover is attached to the inner core adjacent the opposite end portions of the outer cover.

12. The device according to claim 11, wherein the outer cover is attached to the inner core is held at its stretched length such that the outer cover defines gathered portions when the inner core is returned to its relaxed length.

13. The device according to claim 12, wherein the outer cover has an ungathered length is approximately equal to the stretched length of the inner core.

* * * * *